United States Patent [19]

Quinnell

[11] 4,332,117

[45] Jun. 1, 1982

[54] VERGE AND SOAKER SYSTEMS

[75] Inventor: Geoffrey C. Quinnell, Pembury, England

[73] Assignee: Marley Tile A.G., Zug, Switzerland

[21] Appl. No.: 89,233

[22] Filed: Oct. 29, 1979

Related U.S. Application Data

[63] Continuation of Ser. No. 955,756, Oct. 30, 1978, abandoned.

[30] Foreign Application Priority Data

Oct. 31, 1977 [GB] United Kingdom ..... 45245/77

[51] Int. Cl.[3] ..... E04D 13/15

[52] U.S. Cl. ..... 52/94

[58] Field of Search ..... 52/94–96, 52/58, 60–62, 200, 518, 547, 553

[56] References Cited

U.S. PATENT DOCUMENTS

| | | | |
|---|---|---|---|
| 1,261,276 | 4/1918 | Norton | 52/61 |
| 1,586,700 | 6/1926 | Reinhardt | 52/459 |
| 2,802,433 | 8/1957 | Slangal | 52/96 |
| 3,077,056 | 2/1963 | Albee | 52/518 |
| 3,967,423 | 7/1976 | Hammond | 52/200 |

FOREIGN PATENT DOCUMENTS

| | | | |
|---|---|---|---|
| 6924464 | 9/1969 | Fed. Rep. of Germany . | |
| 7222837 | 6/1972 | Fed. Rep. of Germany . | |
| 2432294 | 1/1976 | Fed. Rep. of Germany . | |
| 1272852 | 11/1960 | France | 52/62 |
| 1272852 | 8/1961 | France | 52/62 |
| 7420199 | 6/1974 | France . | |

*Primary Examiner*—James L. Ridgill, Jr.
*Attorney, Agent, or Firm*—Bacon & Thomas

[57] ABSTRACT

A verge or soaker system for a pitched roof having a number of overlapping tiles or other individual roofing units. The system comprises a plurality of overlapping, individual members. Each member has a channel adapted to cap the upper and lower faces of a tile, adjacent the tiles free edge. Each member advantageously has a longitudinally extending planar portion tapering in height from one end of the member to the other, and a pair of longitudinal, parallel, spaced flanges normal to said portion, and defining the channel.

12 Claims, 4 Drawing Figures

VERGE AND SOAKER SYSTEMS

This is a continuation of application Ser. No. 955,756, filed Oct. 30, 1978, now abandoned.

This invention relates to roofing systems and is particularly concerned with verge and soaker arrangements for pitched roofs of tiles, slates or other individual units.

It is known to cover the edges of tiles on a pitched roof, with a continuous extruded verge member of box-like section. This member masks the stepped edge formed by the overlapping tiles and provides a smooth edge. The resultant appearance of the roof may be considered to be less appealing than the traditional appearance. The verge member may be adapted to act as a so-called secret gutter, to carry down the roof water which has blown across the roof into the verge member. Whilst this may be convenient in some arrangements, frequently the secret gutter is too low for the water to be fed to the eaves gutter.

It has been proposed to employ individual, telescoping verge units. These enable a traditional stepped appearance to be obtained, and have certain other, structural advantages. Nevertheless, the secret gutter formed by these units may still be too low for feeding water to an eaves gutter, and the telescoping of the units may be such that water can pass down the joint between adjacent units as it flows down the secret gutter.

Certain problems have also been encountered where tiles on a roof are laid next to an abutment such as a chimney stack or wall. A traditional soaker system at such an abutment may comprise a sheet of lead or other flexible material, folded so as to have an L-shaped section, with one leg of the L being against the abutment, and the other extending under the tiles. To ensure proper weathering, the material must extend a substantial distance under the tiles. A system employing a secret gutter has been proposed, but once again this may not be able to feed water to an eaves gutter.

According to the invention there is provided a verge or soaker system for a pitched roof having a plurality of overlapping tiles or other units, said system comprising a plurality of individual verge or soaker members adapted to overlap one another, each member being provided with a channel adapted to cap the upper and lower faces of a said tile or other unit, adjacent the free edge thereof.

In the case of a verge system, by "free edge" is meant the edge of the tile or other unit which is adjacent the verge of the roof, and in the case of a soaker system by "free edge" is meant edge of the tile or other unit which is adjacent an abutment.

The use of individual verge or soaker members enables a traditional, stepped appearance to be obtained. Furthermore, by capping both the upper and lower faces of tile, the passage of water beneath the tile, for example as a result of water being blown across the roof, can be restricted. In this manner, the use of secret gutter or like arrangement can be avoided and the flow of water down the roof kept at the level of the tiles so that it can be fed to an eaves gutter.

In a soaker system, the members may overlap by being simply laid one upon the other, whereas in a preferred embodiment of a verge system, the members; which are of box-like section, overlap by being telescoped one within the other. In either case, although the channel should be of constant width, the member preferably tapers over its length so as to give the correct appearance on a roof.

Thus the invention also provides a verge or soaker member for use in a roof system as above described, having a longitudinally extending planar portion tapering in height from one end of the member to the other, and a pair of longitudinally extending, spaced flanges extending substantially normal to said portion and defining a channel of substantially constant width extending therealong.

In preferred arrangements, one of said flanges extends along one edge of said planar portion. In the case of a verge member there may advantageously be provided a third flange extending from the other edge of the member, in the same direction as the other two flanges. The members may be made of a suitable plastics such as P.V.C., or be e.g. P.V.C. covered steel.

Two embodiments of the invention will now be described by way of example and with reference to the accompanying drawings, in which.

Figure 1:
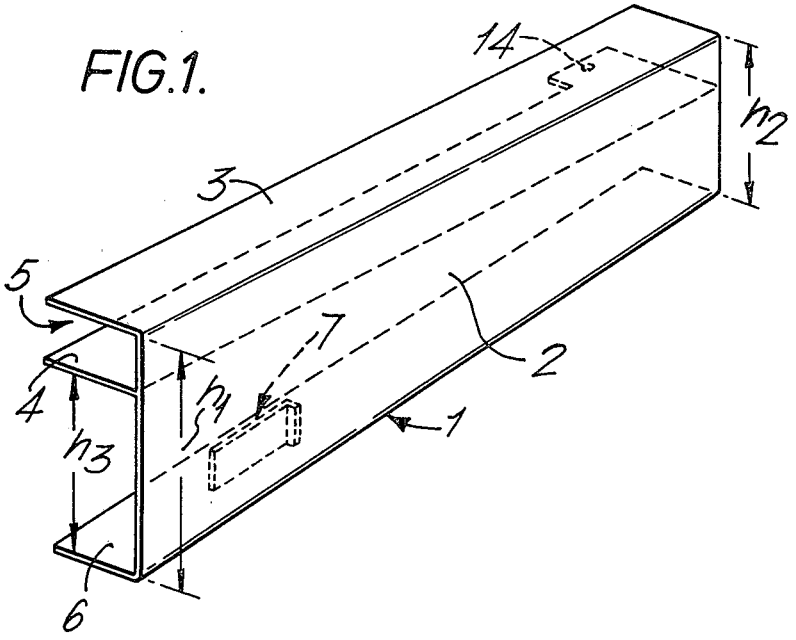
FIG. 1 is a perspective view of a verge member in accordance with the invention.

Referring now to these drawings, in FIG. 1 is shown a verge member 1, in this embodiment of P.V.C. The member comprises a planar portion 2, tapering in height along its length, height $h_1$ being greater than height $h_2$. Along one edge of the portion 2 is provided a flange 3, and parallel to this is a second flange 4, the two flanges 3 and 4 defining a channel 5 extending along the member 1. A third flange 6 extends along the other edge of the portion 2. From this portion 2 extends an L-shaped lug 7 which assists in locating a like member, as will be described hereafter.

Figure 2:
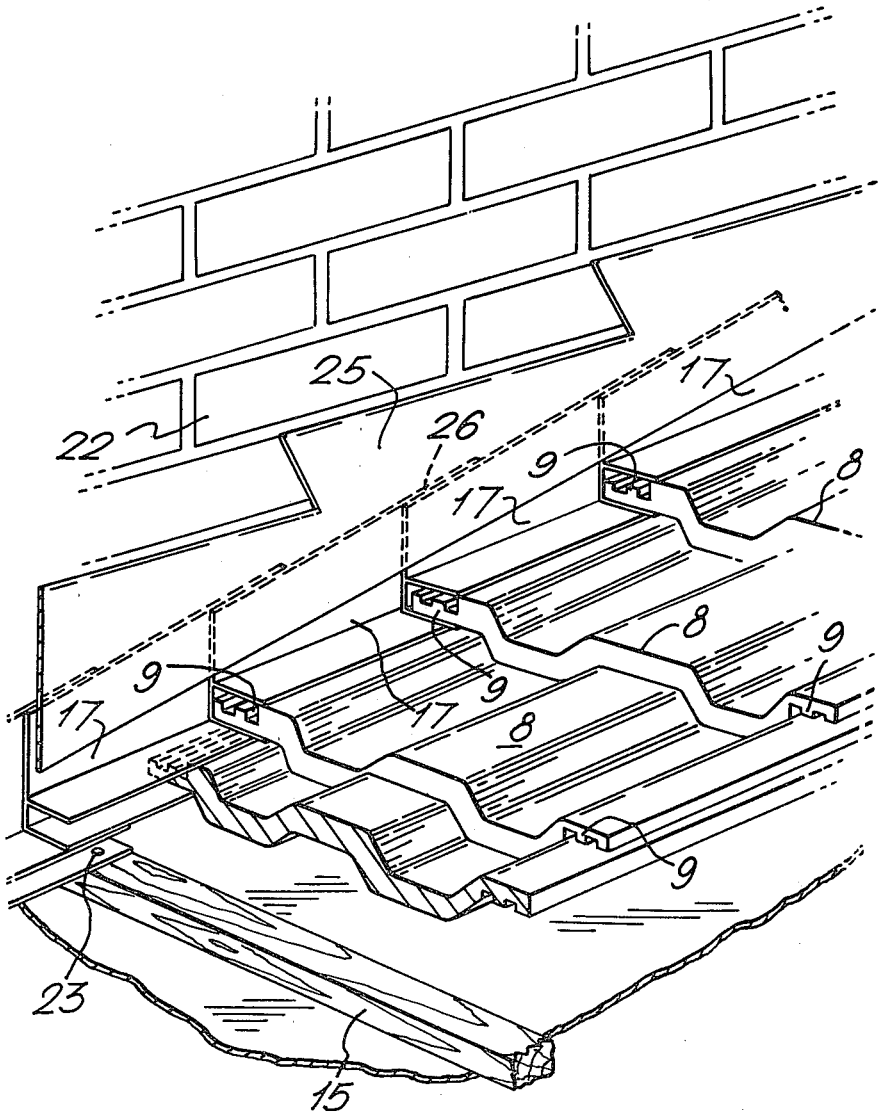
FIG. 2 is a perspective view of a roof verge system employing the member of FIG. 1.

As shown in FIG. 2, a roof comprises a number of overlapping tiles 8, which interlock with adjacent tiles across the roof, by means of interlocking regions 9. On the verge rafter 10 is provided a fascia board 11 which is connected to a soffit 12 in a known manner.

A plurality of the individual verge members 1 are telescoped one within the other and are secured for example by means of a nail 13 passing through a fixing hole 14 (FIG. 1) and into a tile batten 15. The planar portion 2 of one member 1 is located behind the lug 7 of an adjacent member. It will be appreciated that the height $h_2$ must be less than height $h_3$ (FIG. 1) to enable correct telescopic engagement. The taper of the portion 2 is such that the bottom surface 16 of the verge system is generally even, and is parallel to the lower edge of the fascia 11.

In the channel 5 of each member 1 is received the edge of a tile 8, with the flanges 3 and 4 bearing down on the upper and lower surfaces of the tile. The flanges extend only over the interlocking region 9 of each tile 8. Such regions may be standard for a variety of tiles, so that the precise tile profile need not interfere with correct tile/verge member engagement. If desired, suitable filler elements (not shown) could be used to make the top or bottom surface of the tile region 9 flush with flange 4, as applicable.

With the above described arrangement, water is substantially prevented from entering the verge structure. Any water blown across a tile 8, which might enter a channel 5 will flow down onto the upper surface of the next verge member. In this manner, the water can flow down to an eaves gutter.

Figure 3:
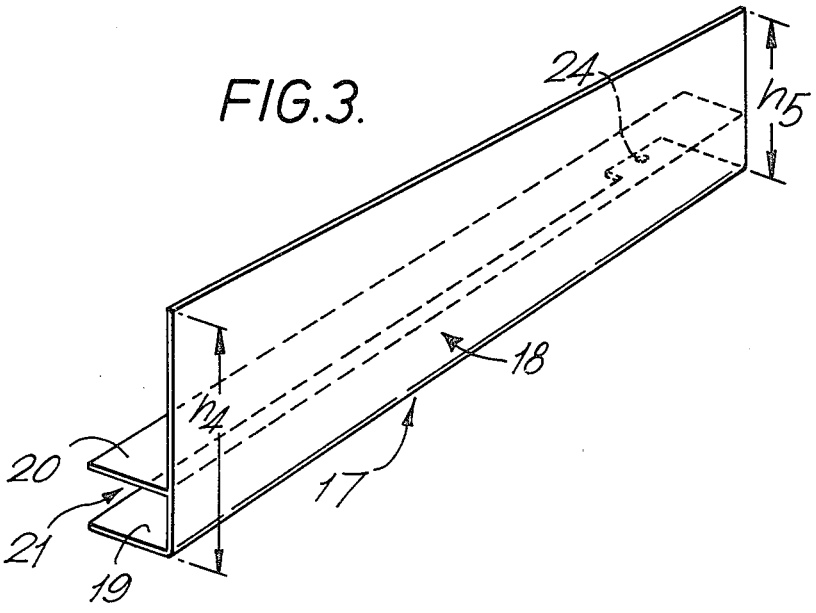
FIG. 3 is a perspective view of a soaker member in accordance with the invention.

Referring now to FIG. 3, there is shown a soaker member 17, comprising a planar portion 18 which tapers in height, $h_4$ being greater than $h_5$. Along the lower edge of the portion 18 is a flange 19, and parallel to this is a second flange 20, the flanges 19 and 20 defining a channel 21 extending along the member 17.

Figure 4:
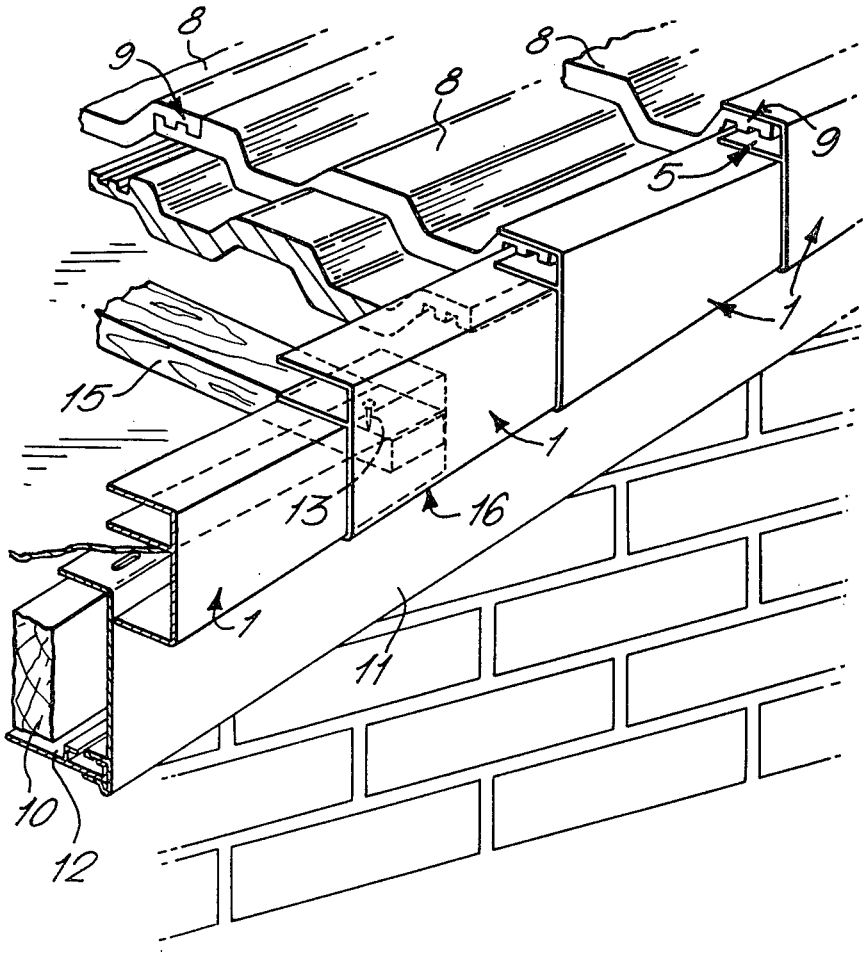
FIG. 4 is a perspective view of a roof soaker system employing the member of FIG. 3.

FIG. 4 shows a number of such soaker members employed in a roof soaker system. In this arrangement, a plurality of tiles 8 abut against a chimney stack 22. Along the stack 22 are secured a plurality of members 17, in overlapping relationship, by means of e.g. nails such as 23 passing through holes 24 (FIG. 3) and into a tile batten 15. The presence of nails 23 does not interfere with the engagement of a tile nib over the batten 15.

In a manner analogous to that used in the verge system of FIG. 2, interlocking regions 9 of the tiles 8 are received in channels 21 of the soaker members 17. Once again therefore, there is effective weathering of the edges of the tiles, water being substantially prevented from entering the soaker structure, and water which might enter a channel 21 will flow down onto the next soaker member and will stay at a level such that it can flow to an eaves gutter. To weather the upper edges of the members 17, flashing 25, e.g. of lead sheet, is provided. The taper of the portion 18 of each member 17 is such that a level upper surface 26 of the soaker system can be obtained with a reasonable degree of overlap of adjacent members.

What is claimed is:

1. A pitched roof having a plurality of longitudinally overlapping individual roofing units, each of which has interlocking regions extending adjacent both lateral edges thereof, the roofing units over the major part of the roof being laterally interlocked along both edges by means of said interlocking regions, and there being a part of said roof where a longitudinal row of roofing units have one edge interlocked with laterally adjacent units and one free edge, the free edges being capped by a plurality of overlapping individual capping members each provided with a channel capping the upper and lower faces of a respective roofing unit, the channel being defined between a pair of short rigid flanges which extend only over the unused interlocking region adjacent the free edge of the respective roofing unit.

2. A roof as claimed in claim 1 wherein said part of the roof is adjacent an abutment and each said capping member is in the form of a soaker member.

3. A roof as claimed in claim 2 wherein the soaker members overlap telescopically.

4. A roof as claimed in claim 3 wherein each soaker member tapers along its length.

5. A roof as claimed in claim 4 wherein each soaker member has a longitudinally extending planar portion tapering in height from one end of the member to the other, said flanges extending substantially normal to said portion and defining a channel of substantially constant width extending therealong.

6. A roof as claimed in claim 5 wherein one of said flanges extends along one edge of said planar portion.

7. A roof as claimed in claim 1 wherein said part of the roof is a verge thereof and each said capping member is in the form of a verge member.

8. A roof as claimed in claim 7 wherein the verge members engage telescopically.

9. A roof as claimed in claim 8 wherein each verge member tapers along its length.

10. A roof as claimed in claim 9 wherein each verge member has a longitudinally extending planar portion tapering in height from one end of the member to the other, said flanges extending substantially normal to said portion and defining a channel of substantially constant width extending therealong.

11. A roof as claimed in claim 10 wherein one of said flanges extends along one edge of said planar portion.

12. A roof as claimed in claim 11 including a third flange extending from the other edge of the member, in the same direction as the other two flanges.

* * * * *